US010589824B2

(12) United States Patent
Bridgewater et al.

(10) Patent No.: US 10,589,824 B2
(45) Date of Patent: Mar. 17, 2020

(54) REPOSITIONABLE SHADE SYSTEM FOR BOATS

(71) Applicant: GEM PRODUCTS, INC., Orange Park, FL (US)

(72) Inventors: Erle Matthew Bridgewater, Orange Park, FL (US); Matthew Stewart Onorato, Orange Park, FL (US); Wylie Davin Nagler, Orange Park, FL (US); Michael Joseph Fafard, Orange Park, FL (US)

(73) Assignee: GEM Products, Inc., Jacksonville, FL (US)

( * ) Notice: Subject to any disclaimer, the term of this patent is extended or adjusted under 35 U.S.C. 154(b) by 0 days.

(21) Appl. No.: 15/717,370

(22) Filed: Sep. 27, 2017

(65) Prior Publication Data

US 2019/0092429 A1 Mar. 28, 2019

(51) Int. Cl.
*B63B 17/02* (2006.01)

(52) U.S. Cl.
CPC ..... *B63B 17/02* (2013.01); *B63B 2017/026* (2013.01)

(58) Field of Classification Search
CPC ..... B63B 17/02
USPC ..... 114/361
See application file for complete search history.

(56) References Cited

U.S. PATENT DOCUMENTS

| | | | | |
|---|---|---|---|---|
| 7,114,283 | B2 * | 10/2006 | Slatter | A01K 91/08 43/27.4 |
| 7,370,597 | B1 | 5/2008 | Schwindaman | |
| 8,857,366 | B2 | 10/2014 | Russikoff | |
| 9,625,087 | B2 | 4/2017 | Samowski | |
| 2011/0083356 | A1 * | 4/2011 | Rupp | A01K 87/025 43/27.4 |
| 2013/0206050 | A1 * | 8/2013 | Russikoff | B63B 17/02 114/361 |
| 2017/0089374 | A1 | 3/2017 | Onorato | |

OTHER PUBLICATIONS

The Hull Truth Boating Forum "help from the redneck engineers in THT." posted Jan. 27, 2016 by user "emudryj". Retrieved from Internet: <https://www.thehulltruth.com/boating-forum/730655-help-redneck-engineers-tht.html>. 4 Screen shots of related posts for an outrigger shade system (Year: 2016).*

(Continued)

*Primary Examiner* — Anthony D Wiest
(74) *Attorney, Agent, or Firm* — Seyfarth Shaw LLP

(57) ABSTRACT

An adjustable shade system for a boat is disclosed. The shade system includes at least one canvas and at least one pole, for example, an outrigger pole. The at least one canvas is secured to the at least one pole using at least one attachment point. In addition, the shade system includes at least one pivoting connection. The pivoting connection is coupled to a mounting surface and to the first end of the at least one pole. The pivoting connection is adapted to selectively cause the at least one pole to rotate in at least one rotational direction relative to the mounting surface.

13 Claims, 19 Drawing Sheets

(56) References Cited

OTHER PUBLICATIONS

Rear Shade Kit. Datasheet [online]. Bridsall Marine Design [retrieved on Aug. 30, 2018]. Retrieved from the Internet<https://marineproducts.net/rear-shade-kit/> 2 Screen shots plus Wayback machine screenshot (showing internet page archived as early as Jun. 27, 2017) (Year: 2017).*

Mantis Boat Umbrella: https://www.pro-techt.com/mantis-original-pro.html, retrieved from the internet on Mar. 12, 2019, Screen captures in Wayback Machine as early as Jun. 27, 2009 (Year: 2009).*

* cited by examiner

REPOSITIONABLE SHADE SYSTEM FOR BOATS

TECHNICAL FIELD OF THE INVENTION

The present invention relates generally to shade structures for boats. More particularly, the present invention relates to a structure that allows for a shaded area on a boat that can be quickly and easily adjusted to allow for optimal positioning of the shaded area.

BACKGROUND OF THE INVENTION

In boating it is often desirable to seek shelter from the sun or other weather elements, such as rain, but few boats include structures that provide a significant amount of shaded or protected area. One common method for providing shade or weather protection to a boat is the addition of a Bimini top, which is a fixed structure that cannot be adjusted to allow for optimal placement of shade relative to the changing position of the sun. Rather, such Bimini tops are generally sized to only provide shade to a cockpit area of the boat. Also, installation of a Bimini top requires hardware to be permanently attached to the boat, including a number of uprights that extend from the boat to a framed canvas, which can restrict access to the boat or a user's ability to fish from the boat. One example of such a system is described in U.S. Pat. No. 7,370,597 to Schwindaman.

Another method of providing shade or weather protection is the addition of a retractable boat canopy, such as described in U.S. Pat. No. 8,857,366 to Russikoff. This type of system typically includes a canvas supported by a telescoping frame, which is attached to or integral with an upright structure surrounding the cockpit area of the boat, commonly referred to as a tower. However, this shade cannot be adjusted to allow for optimal placement of shade relative to the changing position of the sun. This solution also requires hardware to be permanently attached to a boat, and does not allow for an additional shaded area that is substantially wider than that already provided by a tower.

SUMMARY OF THE INVENTION

The present invention broadly comprises a selectively deployable system for applying shade and/or weather protection to a boat, which allows a user to adjust the size and placement of shade or weather protection within or next to a boat. In an embodiment, the system broadly includes two rigid poles, each pivotally coupled to an upright structure of a boat, and a canvas stretched between and selectively attached to the poles at multiple points along the length of each pole.

In another embodiment, the system broadly includes a canvas held taut along an axis by the inclusion of stringers at the ends proximal and distal from the upright structure. In this embodiment, the poles are attached to the stringers instead of the edges of the canvas, which allows for the canvas to be wider than a distance between the poles and provides a larger shaded or protected area.

In yet another embodiment, the system broadly includes overlapping canvases attached to the two poles. This allows the user to customize the size of their shade or protected area by choosing the number of sections to install, and when using two overlapping canvasses the system would have greater permeability and experience less force due to air pressure.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
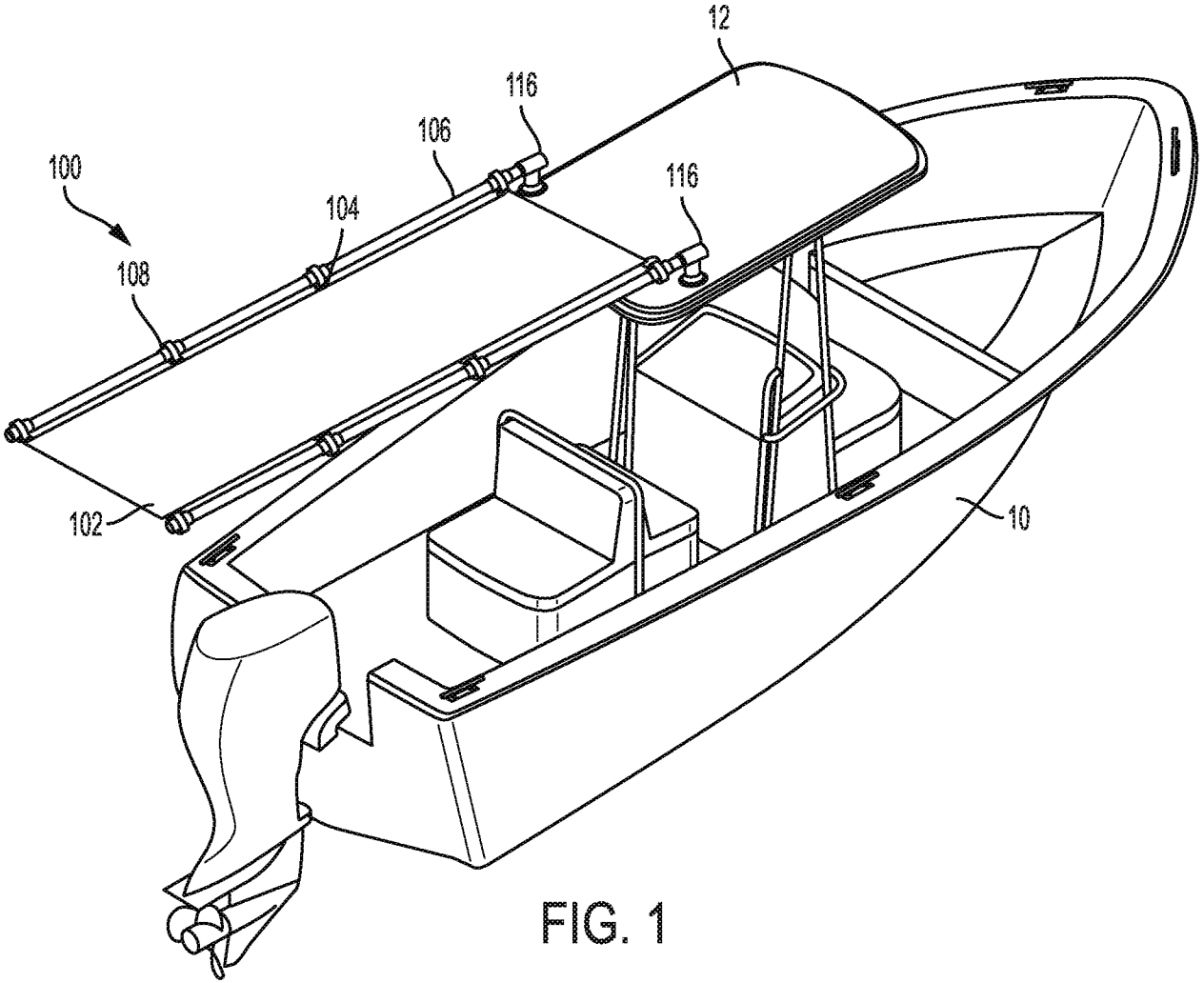
FIG. 1 is a perspective side view of a repositionable shade system according to an embodiment of the present invention attached to a typical boat.
Figure 2:
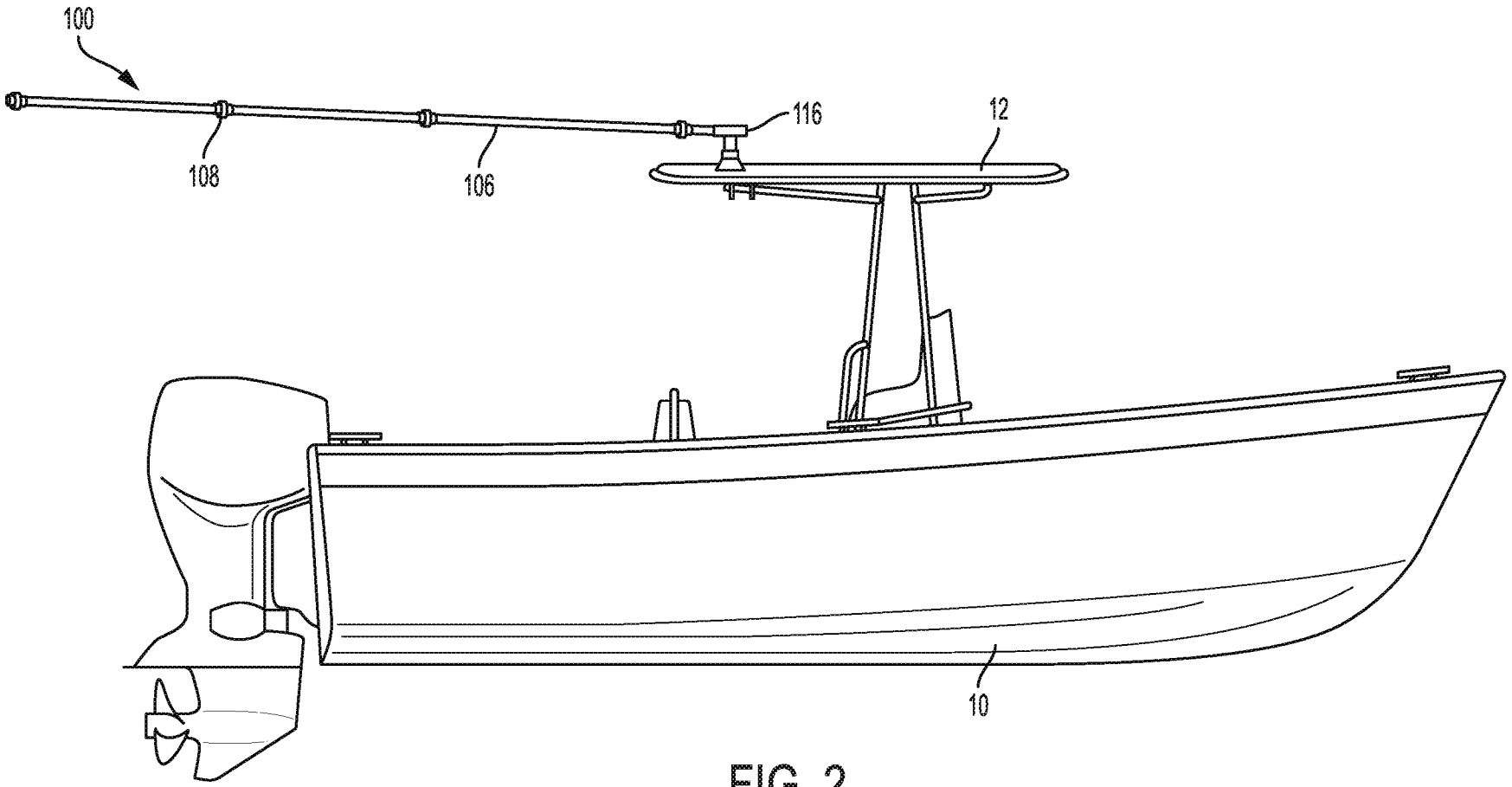
FIG. 2 is a side elevation view of the repositionable shade system according to FIG. 1 attached to a typical boat.
Figure 3:
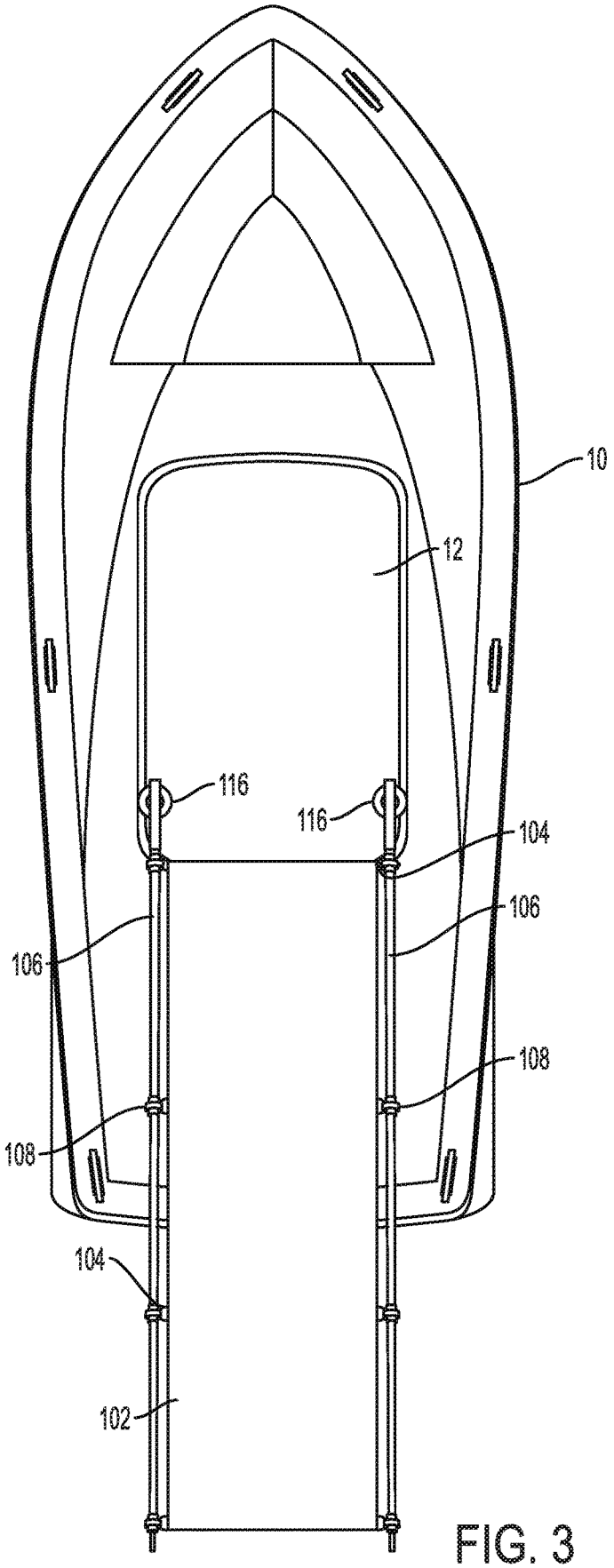
FIG. 3 is a top plan view of the repositionable shade system according to FIG. 1 attached to a typical boat.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only. Moreover, while the present invention disclosed herein may be described as apply shade from sun, it should be understood that the present invention also provides protection from other weather related elements, such as, for example, rain.

An embodiment of the present invention provides structures that allow for a shaded or protected area on a boat. The structures can be quickly and easily adjusted to allow for optimal positioning of the shaded or protected area within or next to a typical boat. In an embodiment, the system broadly includes at least one canvas and at least one pole, for example, an outrigger pole. The canvas is secured to the pole using at least one attachment point. In addition, the system includes at least one pivoting connection. The pivoting connection is coupled to a mounting surface and to a first end of the pole. The pivoting connection is adapted to selectively cause the pole to rotate in at least one rotational direction relative to the mounting surface.

Referring to FIGS. 1-4, in an embodiment, a shade/protection system 100 of the present invention broadly includes at least one canvas 102 with at least one attachment point 104 that couples to at least one pole 106 or another attachment point on the pole 106. The canvas 102 provides a shaded/protected area, as well as, protection from the sun or weather elements for a user of the shade/protection system 100. In addition, the canvas 102 may be permeable to prevent excess force from being applied to the shade system 100 by, for example, wind. As illustrated in FIGS. 1-4, the canvas 102 is rectangular in shape, however, the canvas 102 may be any other geometric shape adapted to provide a desired amount of shade/protection without departing from the scope and spirit of the present invention.

The attachment points 104 may be tethers, clips (such as hook ring or D-clips) or other means of attaching the canvas 102 to the poles 106 or another attachment point on the poles 106. In an example, the attachment point(s) 104 may be a strap that extends from the canvas 102 to the pole 106. The strap may be adapted to be coupled directly with the pole 106, or another attachment point on the pole 106. The strap may also have an adjustable length. In another example, the attachment point(s) 104 may be a clip adapted to be coupled directly with the pole 106, or another attachment point on the pole 106. In yet another embodiment, the attachment point(s) 104 is a pocket that is congruent with the canvas 102 and adapted to accept a length of the pole 106. As described above, the canvas 102 may be installed or uninstalled by engaging or disengaging the attachment points 104 with the pole 106, or another attachment point on the pole 106.

The pole 106 may be a telescopic outrigger pole that is substantially rigid with a substantially small amount of flex. Some examples of materials that can be used for the pole 106 include, but are not limited to, metal, plastic, fiberglass, carbon fiber, and other composite materials. The pole 106 may be adjustable so the user is able to adjust the shaded/protected area to a desired size. For example, the pole 106 may include at least two tubes having different diameters and sized to allow a smaller of the tubes to be received within a larger of the tubes in a telescopic manner. As illustrated in FIGS. 1-4, there are two poles 106, each having three nestable tubes that extend and retract in a telescopic manner.

The telescopic nature of the pole 106 allows for the size of the shaded/protected area to be optimized according to the user's current need. As an example, the stern area of a boat 10 is often smaller than the bow area of the boat 10, so the length of the pole(s) 106 may be adjusted to optimally provide shade to either area.

Each pole 106 may include one or more clamps 108 (also referred to a retaining devices), similar to outrigger clamps described in U.S. Patent Application Publication No. 2017/0089374, filed Jul. 19, 2016, entitled Outrigger Clamp, which is a continuation-in-part and claims the benefit of U.S. Patent Application Publication No. 2017/0086442, filed Sep. 24, 2015, entitled Outrigger Clamp, both of the contents of which are incorporated herein by reference in their entirety. Such a clamp 108 is used to secure the extended or retracted position of two or more nestable tubes of the pole 106. This allows the length of the pole 106 to be adjusted.

Figure 4:
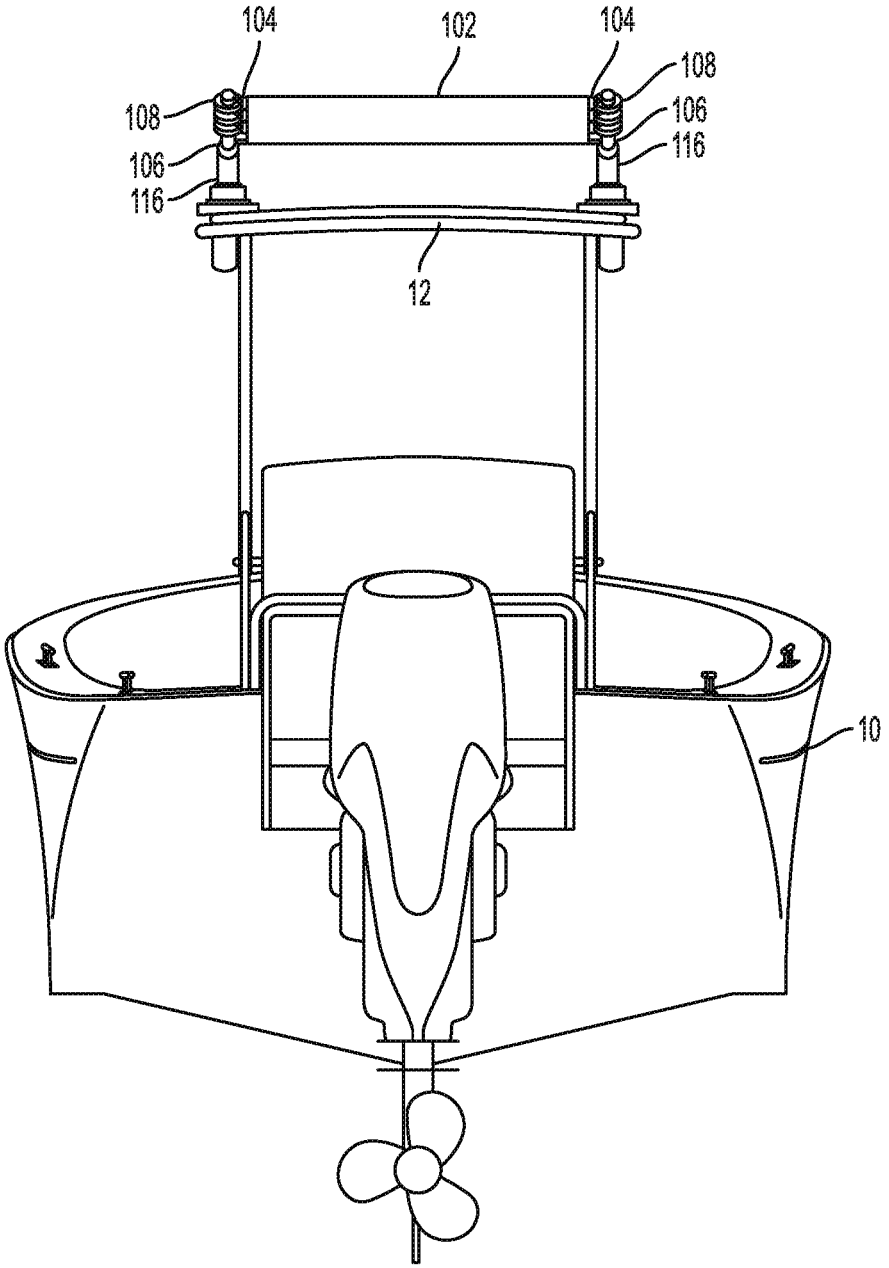
FIG. 4 is a rear elevation view of the repositionable shade system according to FIG. 1 attached to a typical boat.
Figure 5:
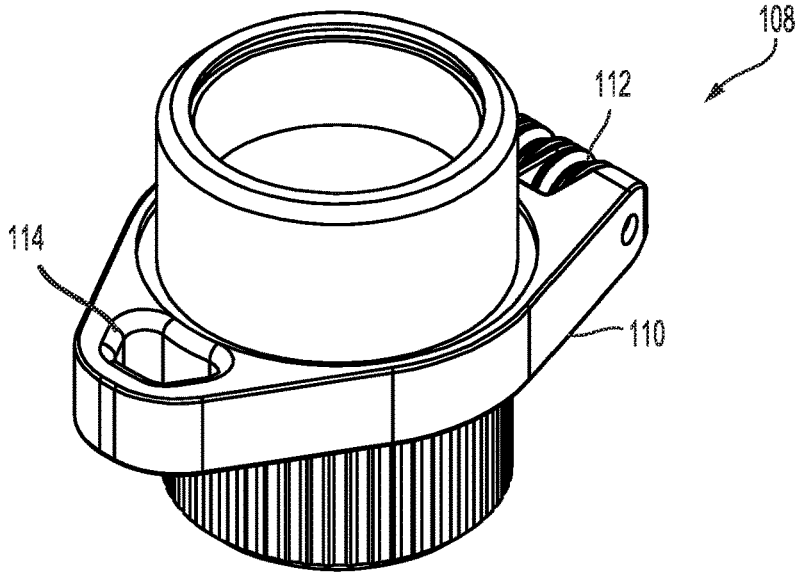
FIG. 5 is a perspective view of an outrigger clamp according to an embodiment of the present invention.

Referring to FIGS. 4 and 5, the clamp(s) 108 may include a coupling portion (also referred to as a body), a first cap and first split ring, a second cap and second split ring, and a guide 110 with one or more retainers 112, as described in U.S. Patent Application Publication No. 2017/0089374. For example, the guide 110 is rotatable about an axis of the clamp 108 to allow an outrigger and filament to align them during use. The retainer 112 can receive and retain a filament of the outrigger and align the filament and other clamps 108 along the outrigger axis. For example, the retainer 112 can be one or more rollers that allow the filament to move axially along the roller. Because the roller is round, the filament can gently engage the guide 112 without creasing or crimping, compared to a more rigid hook or fish eye fastener. As shown, three retainers 112 are disposed in the guide 110. However, more or fewer retainers 112 can be implemented without departing from the spirit and scope of the present application. For example, the number of retainers can be dependent on the size of the nestable tubes coupled together by the clamp 108. In some embodiments, the larger the tubes, the more retainers 112 are disposed on the guide 110.

Additionally, the guide 110 may include an attachment point 114 that allows a user to couple one or more accessories to the clamp 108 without interfering with the guide or filament retained by the guide/retainer. The attachment point 114 can be used to attach the canvas 102 to the guide 110, for example, using the attachment point(s) 104 of the canvas 102. As shown, one attachment point 114 is disposed in or on the guide 110. However, more attachment points 114 can be implemented without departing from the spirit and scope of the present invention. For example, the number of attachment points 114 can be dependent on the number of accessories to be attached to the guide 110.

Further, as shown, the attachment point 114 is disposed on a side of the guide 110 opposite the retainers 112. However, the attachment point 114 may be positioned anywhere along or around the guide 110 so that the attachment point 114 does not interfere with the filament of the outrigger. In addition, a shape of the attachment point 114 may be any shape that allows for attachment of an accessory. For example, the attachment point 114 may be a substantially round shape, a substantially rectangular shape, a substantially triangular shape, a substantially trapezoidal shape, or any other geometric shape.

As illustrated in FIGS. 1-4, there are two poles 106, each having three nestable tubes that extend and retract in a telescopic manner. Accordingly, there are three guides 110 on each pole 106, and each guide 110 includes an attachment point 114.

Figure 6:
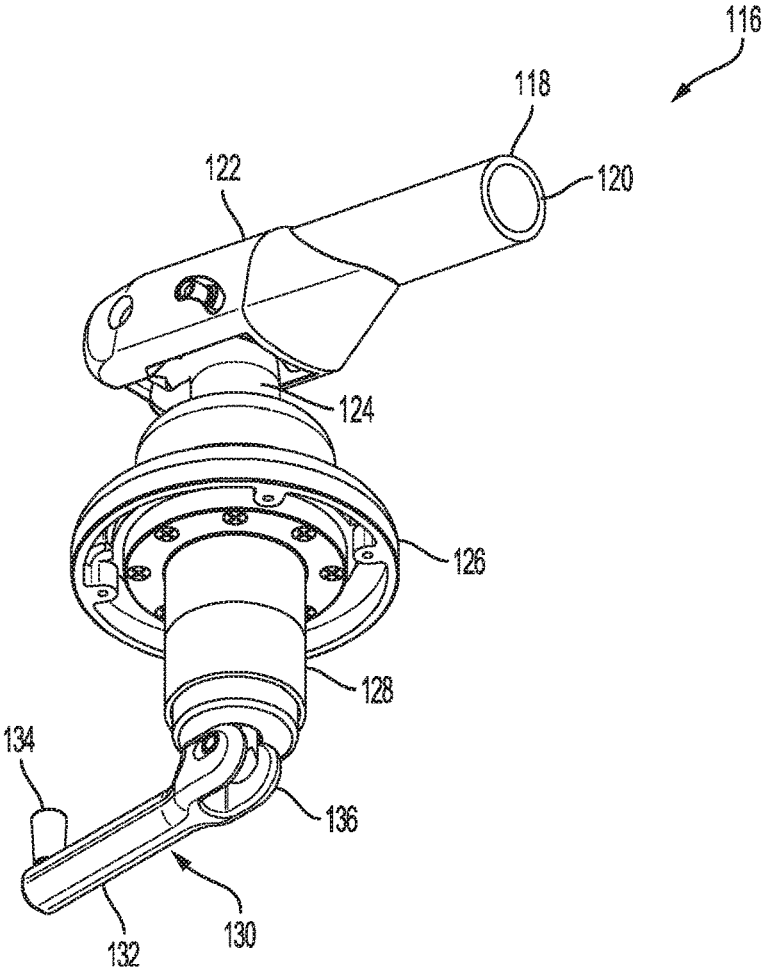
FIG. 6 is a perspective view of an outrigger mount according to an embodiment of the present invention.

Referring to FIG. 6, the shade/protection system 100 may also include at least one pivoting connection 116 coupled to a mounting surface of the boat. The pivoting connection 116 may be an outrigger mount, such as described in U.S. Pat.

No. 9,625,087, filed Sep. 14, 2015, entitled Outrigger Mount, the contents of which is incorporated herein by reference in its entirety.

For example, the pivoting connection 116 may include a tube 118 having an opening 120 and being coupled to or integral with a base 122. The base 122 can rotate about an axis of an upper housing 124 coupled to an enclosure 126. The enclosure 126 can accordingly be coupled to a lower housing 128. A handle 130 can be used to rotate the tube 118 in a first rotational direction, for example, about the axis of the upper housing 124, and a second rotational direction perpendicular to the first rotational direction.

The handle 130 can include a crank 132 having a knob 134 at a first end and a joint 136 at a second end opposite the first end. The knob 134 can be used to rotate the handle 130 and, accordingly, cause the base 122 and tube 118 to rotate in either horizontal or vertical planes, for example. The joint 136 can allow the handle 130 to be disposed in a first position such that when the knob 134 faces upwardly, rotation of the handle 130 causes the tube 118 to rotate in the horizontal plane about an axis of the upper housing 124 and enclosure 126. The handle 130 can also be flipped to a second position such that when the knob 134 faces downwardly, rotation of the handle 130 causes the tube 118 to rotate in the vertical plane perpendicular to the horizontal plane. The direction of the knob 134 can alternately be switched, or have no significance at all, to the application of rotation from the handle 130.

Referring to FIGS. 1-4, first and second pivoting connections 116 can be coupled to a tower 12 or other mounting surface of the boat 10. Ends of the first and second poles 106 are respectively disposed in and coupled to the first and second tubes 118 of the first and second pivoting connections 116. The position of the first and second poles 106 may be adjusted to provide a shaded/protected area, and the canvas 102 coupled to the poles 106, for example, by selectively coupling attachment points 104 of the canvas 102 to the pole 106 or to the attachment points 114 of the clamps 108 disposed along lengths of the poles 106.

The pivoting and rotational nature of the pivoting connections 116 allow for the poles 106 to be oriented in a number of different positions to provide shade/protection to a desired area of the boat 10 or area adjacent to the boat 10. Similarly, the shape of the canvas may be modified to provide the desired amount of shade/protection. The canvas may also have multiple attachment points 104 that allow for the canvas to be folded into different shapes and still couple to the poles 106. In another embodiment, the canvas may include two or more overlapping canvases attached to the two poles 106. This allows a user to customize the size of the shaded/protected area by choosing the appropriate size and number of sections to install.

For example, referring to FIGS. 7-10, a canvas 202 may be used, and the pivoting connections 116 may be adapted to allow the user to independently rotate and position each pole 106 in the first and second rotational directions and in a variety of positions. Additionally, the poles 106 may be locked in a desired rotational position to prevent unwanted movement of the poles 106 that may cause repositioning or resizing of the shaded/protected area. As illustrated in FIGS. 7-10, the canvas 202 has a generally trapezoidal shape, and the pivoting connections 116 and poles 106 are positioned to correspond to the shape of the canvas 202. This provides for a larger shaded/protected area. As mentioned, however, the shape of the canvas 202 can be anything that provides shade/protection without departing from the scope and spirit of the present invention.

In another example, independent rotation in the vertical plane of the pivoting connections 116 and poles 106 allows a user to adjust the size of the shaded/protected area by, for example, causing the canvas to be more perpendicular to a direction of sunlight. For example, referring to FIGS. 11-14, one of the pivoting connections 116 and poles 106 may be tilted to position canvas 202 more perpendicular to a direction of sunlight.

In yet another example, referring to FIGS. 15-18, independent rotation in the vertical and horizontal planes of the pivoting connections 116 and poles 106 allows a user to adjust the size of the shaded/protected area by causing the canvas to be, for example, more perpendicular to a direction of sunlight. For example, one or both of the pivoting connections 116 and poles 106 may be tilted to position canvas 302 more perpendicular to a direction of sunlight.

Figure 7:
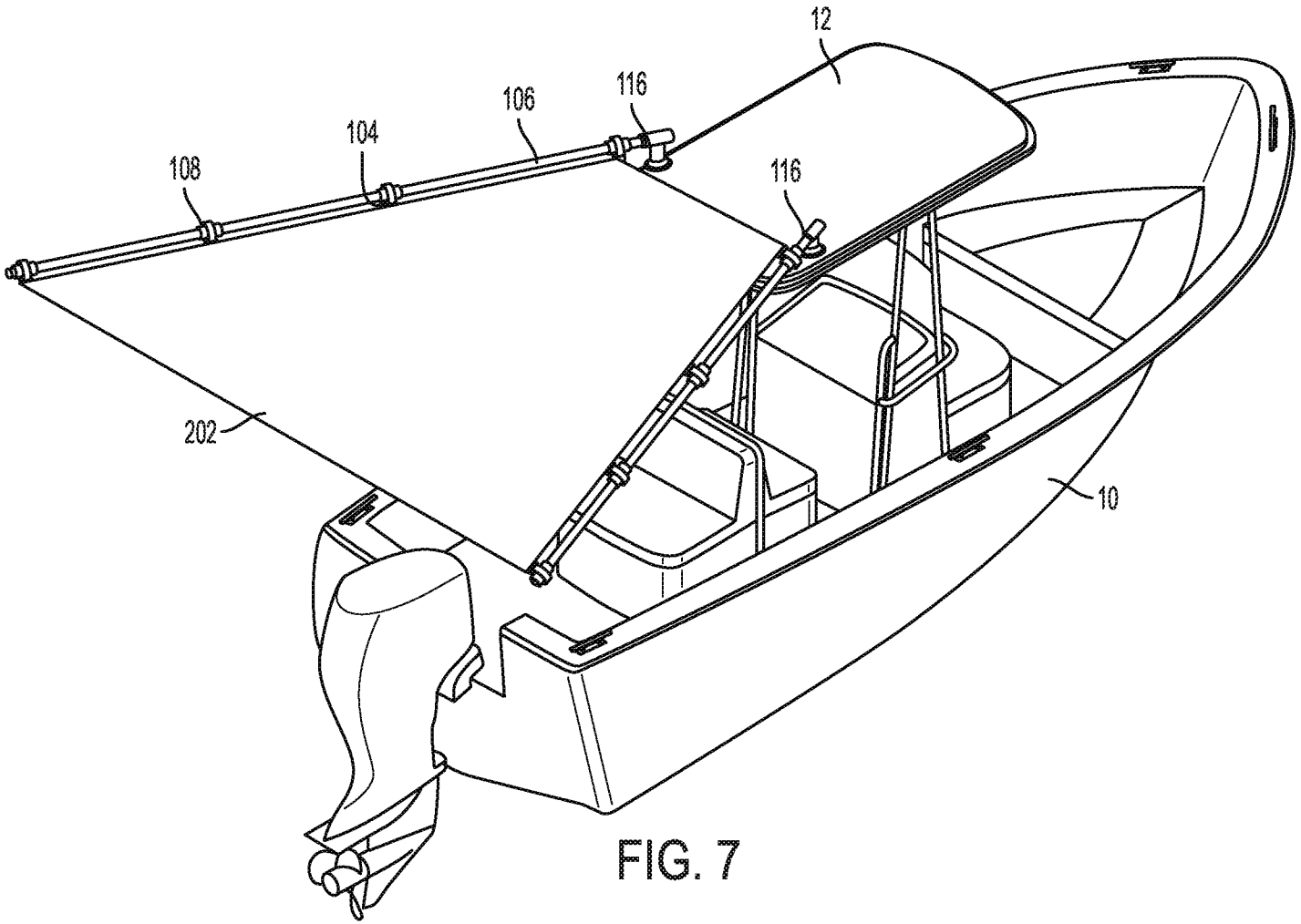
FIG. 7 is a perspective side view of a repositionable shade system according to another embodiment of the present invention attached to a typical boat.
Figure 8:
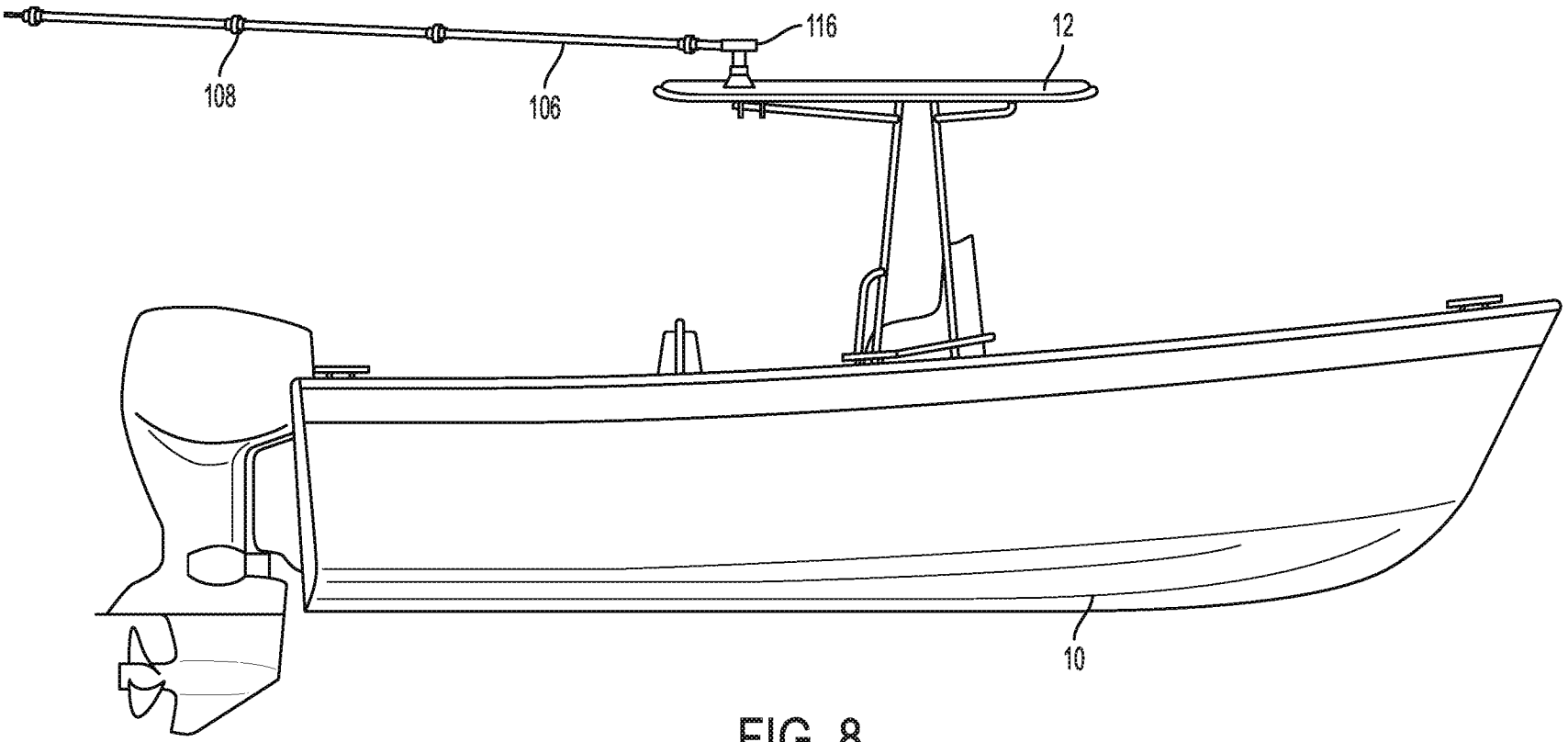
FIG. 8 is a side elevation view of the repositionable shade system according to FIG. 7 attached to a typical boat.
Figure 9:
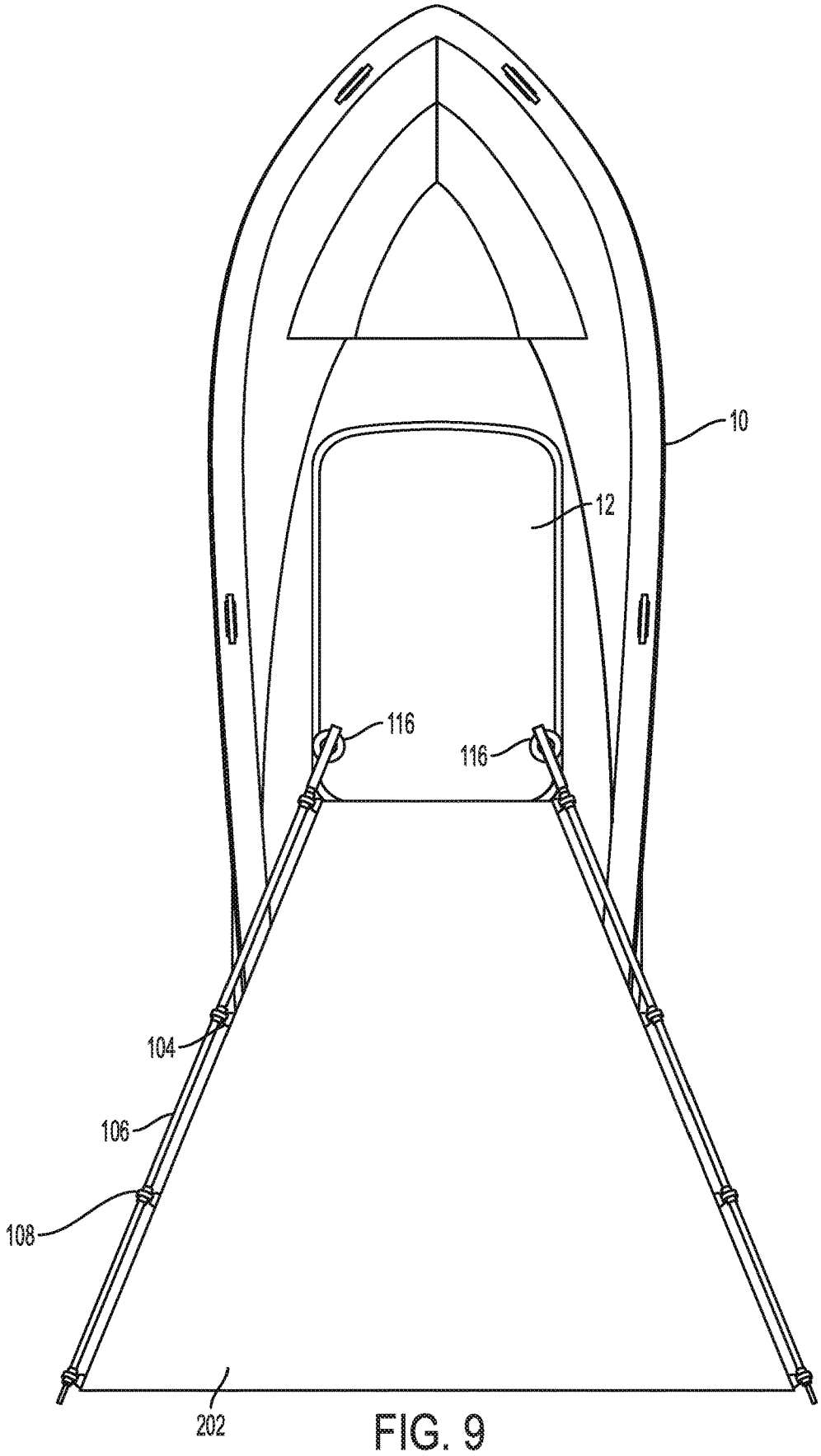
FIG. 9 is a top plan view of the repositionable shade system according to FIG. 7 attached to a typical boat.
Figure 10:
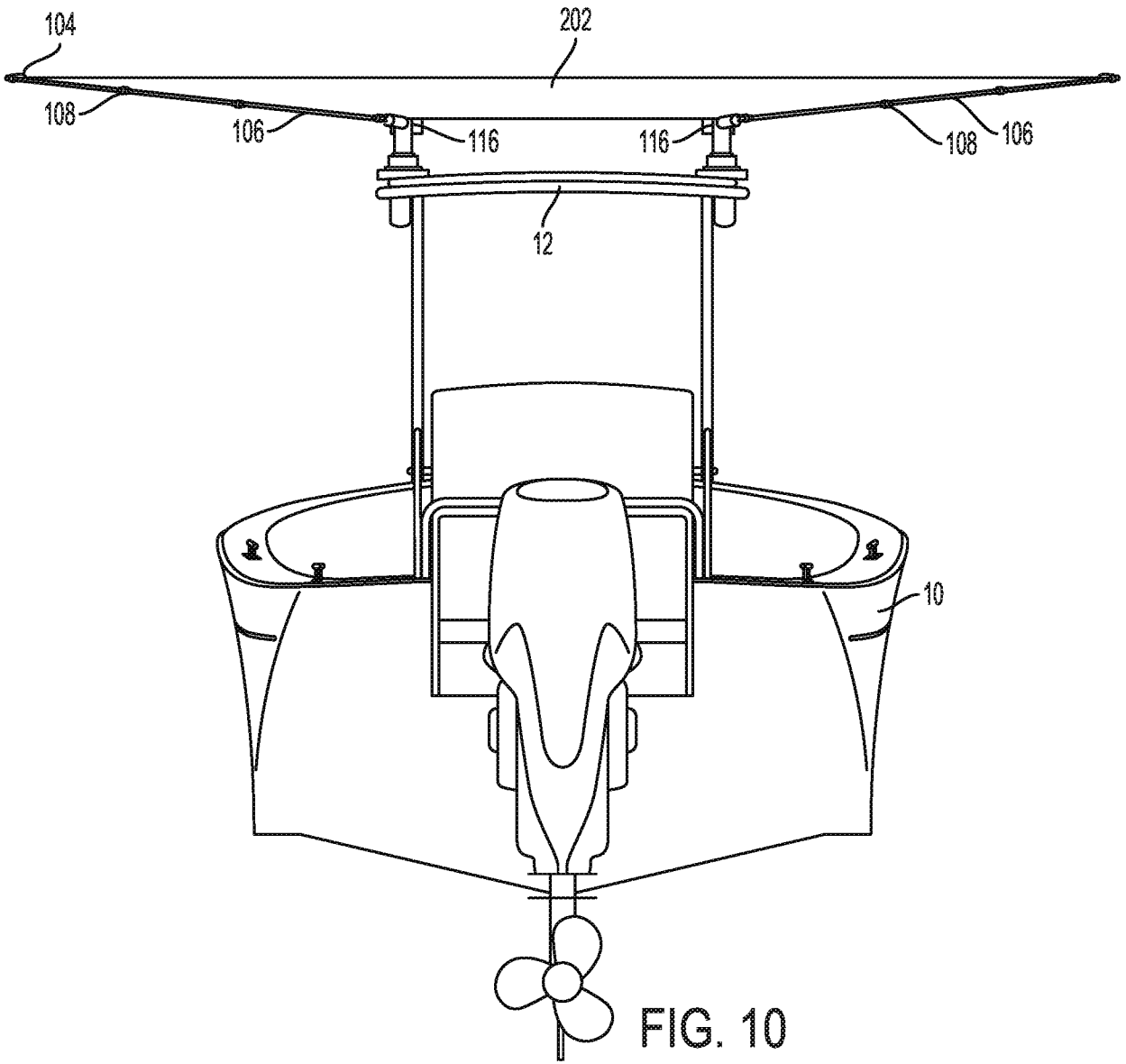
FIG. 10 is a rear elevation view of the repositionable shade system according to FIG. 7 attached to a typical boat.
Figure 11:
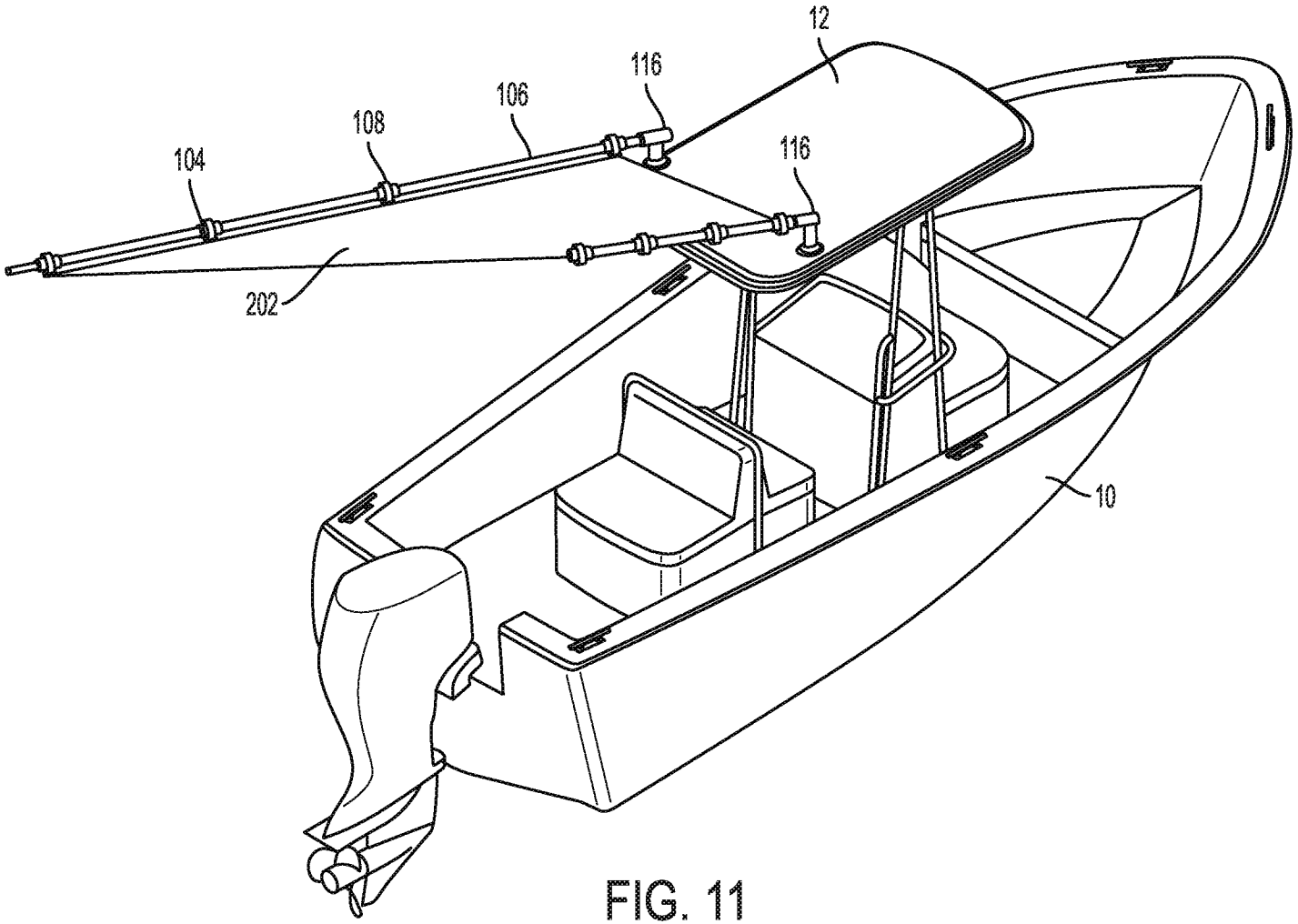
FIG. 11 is a perspective side view of a repositionable shade system according to another embodiment of the present invention attached to a typical boat.
Figure 12:
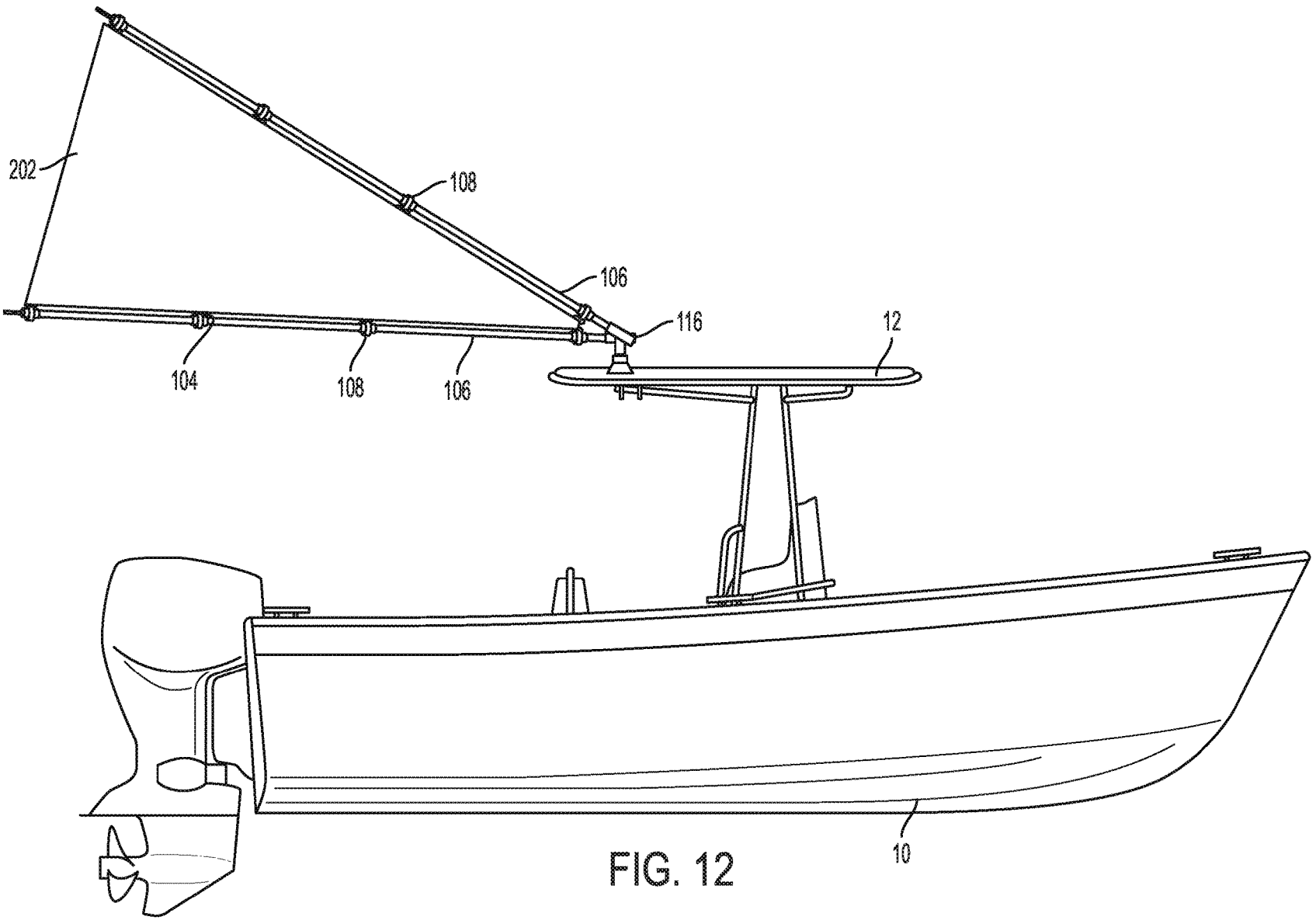
FIG. 12 is a side elevation view of the repositionable shade system according to FIG. 11 attached to a typical boat.
Figure 13:
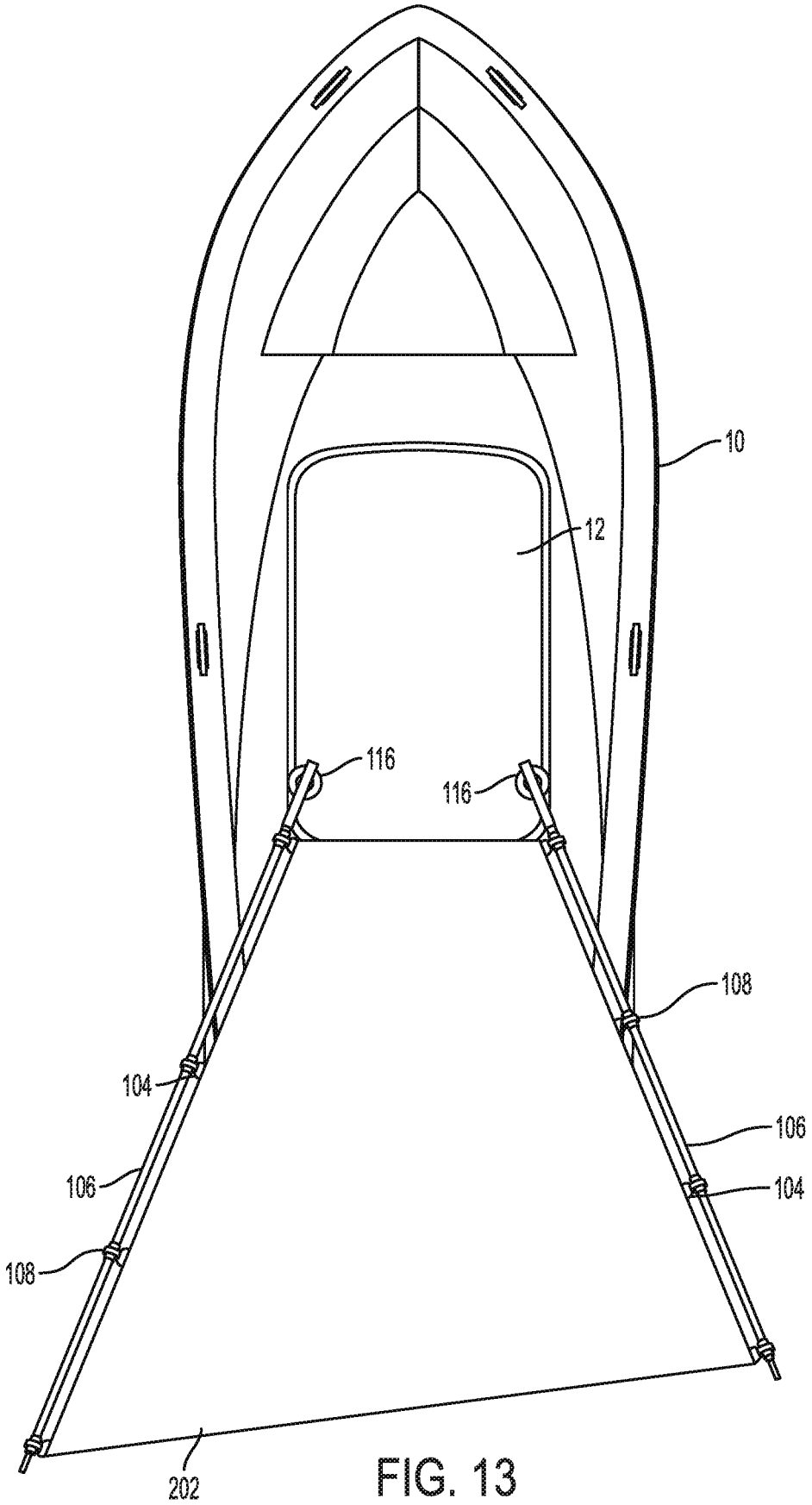
FIG. 13 is a top plan view of the repositionable shade system according to FIG. 11 attached to a typical boat.
Figure 14:
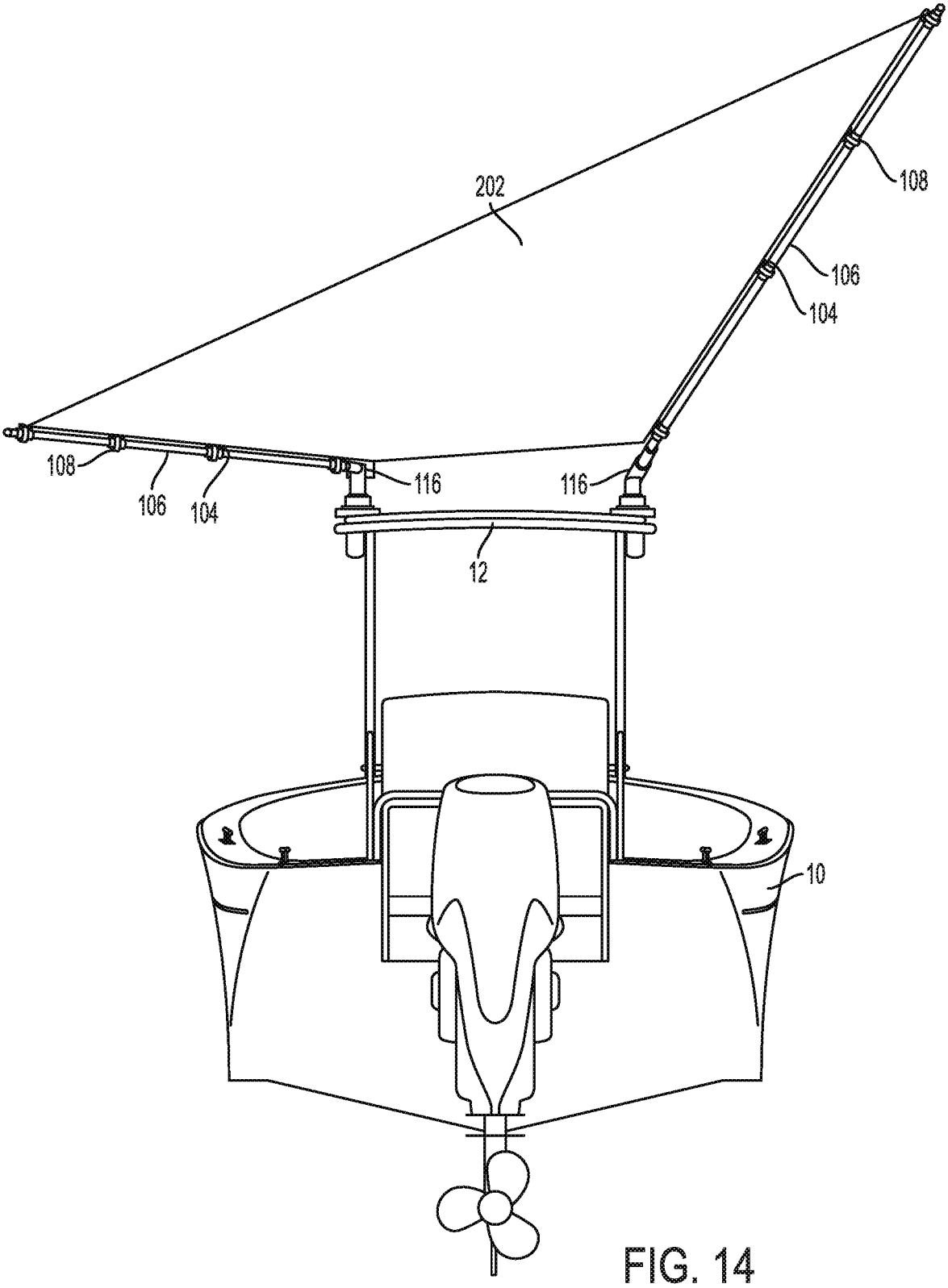
FIG. 14 is a rear elevation view of the repositionable shade system according to FIG. 11 attached to a typical boat.
Figure 15:
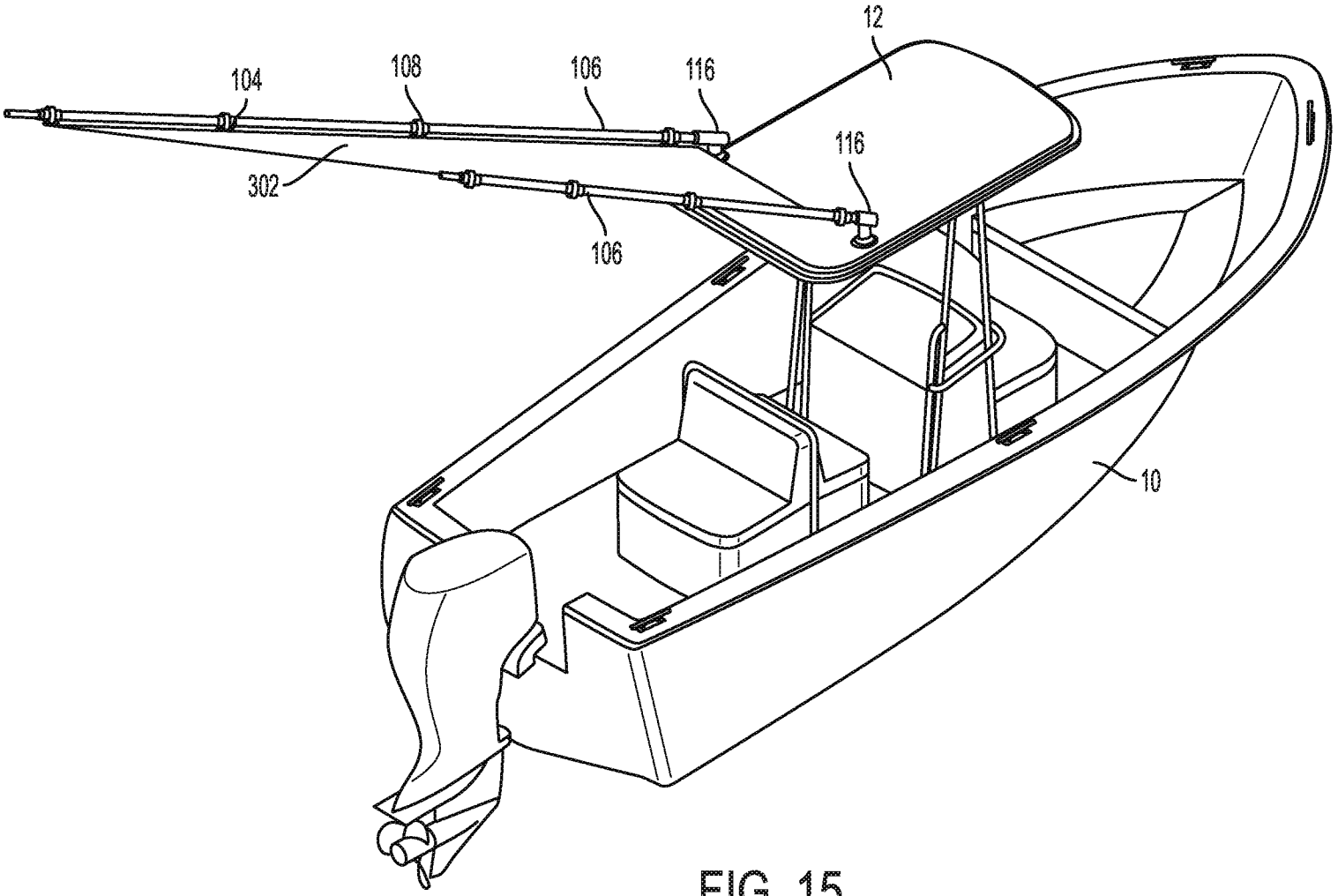
FIG. 15 is a perspective side view of a repositionable shade system according to another embodiment of the present invention attached to a typical boat.
Figure 16:
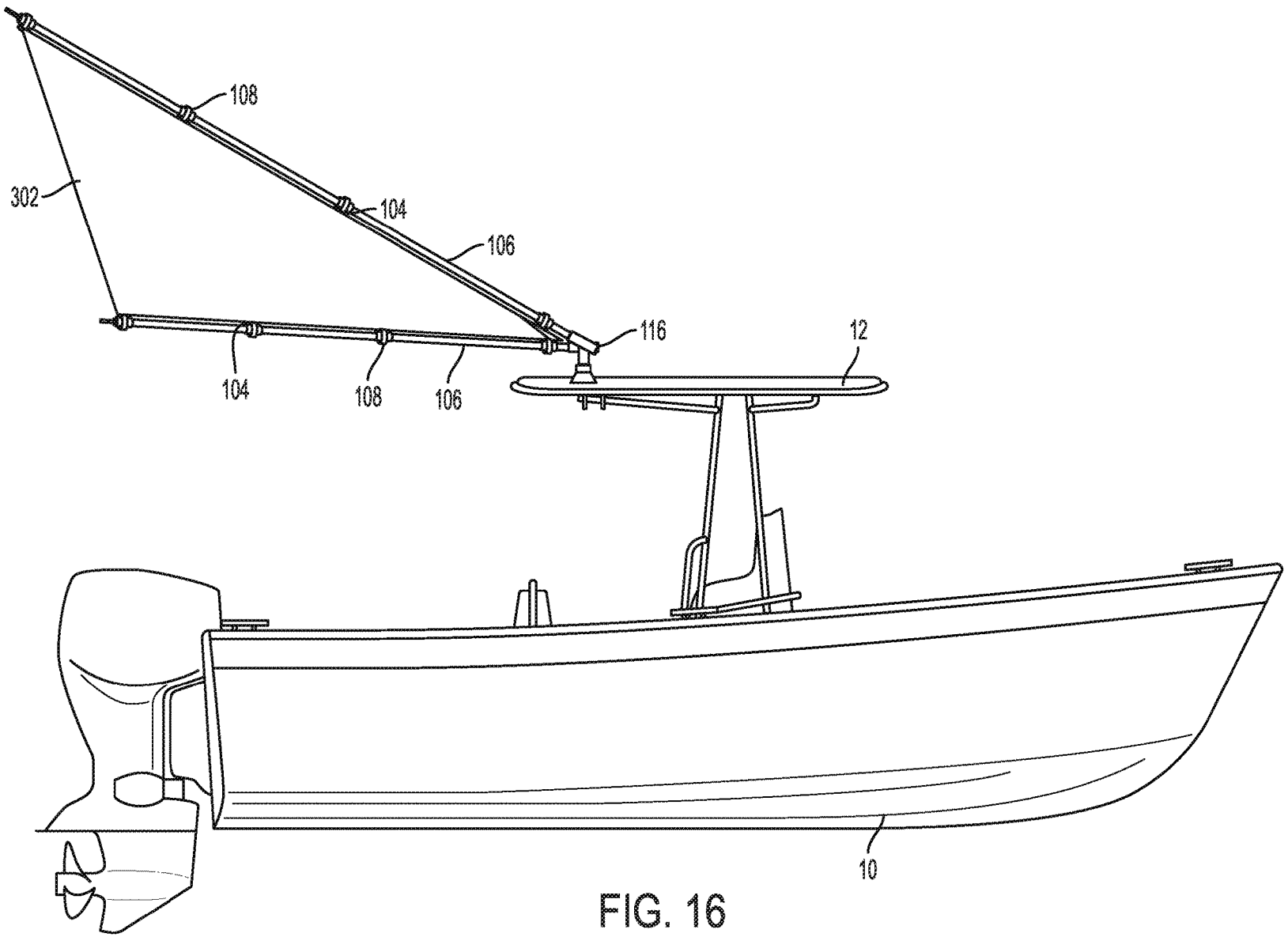
FIG. 16 is a side elevation view of the repositionable shade system according to FIG. 15 attached to a typical boat.
Figure 17:
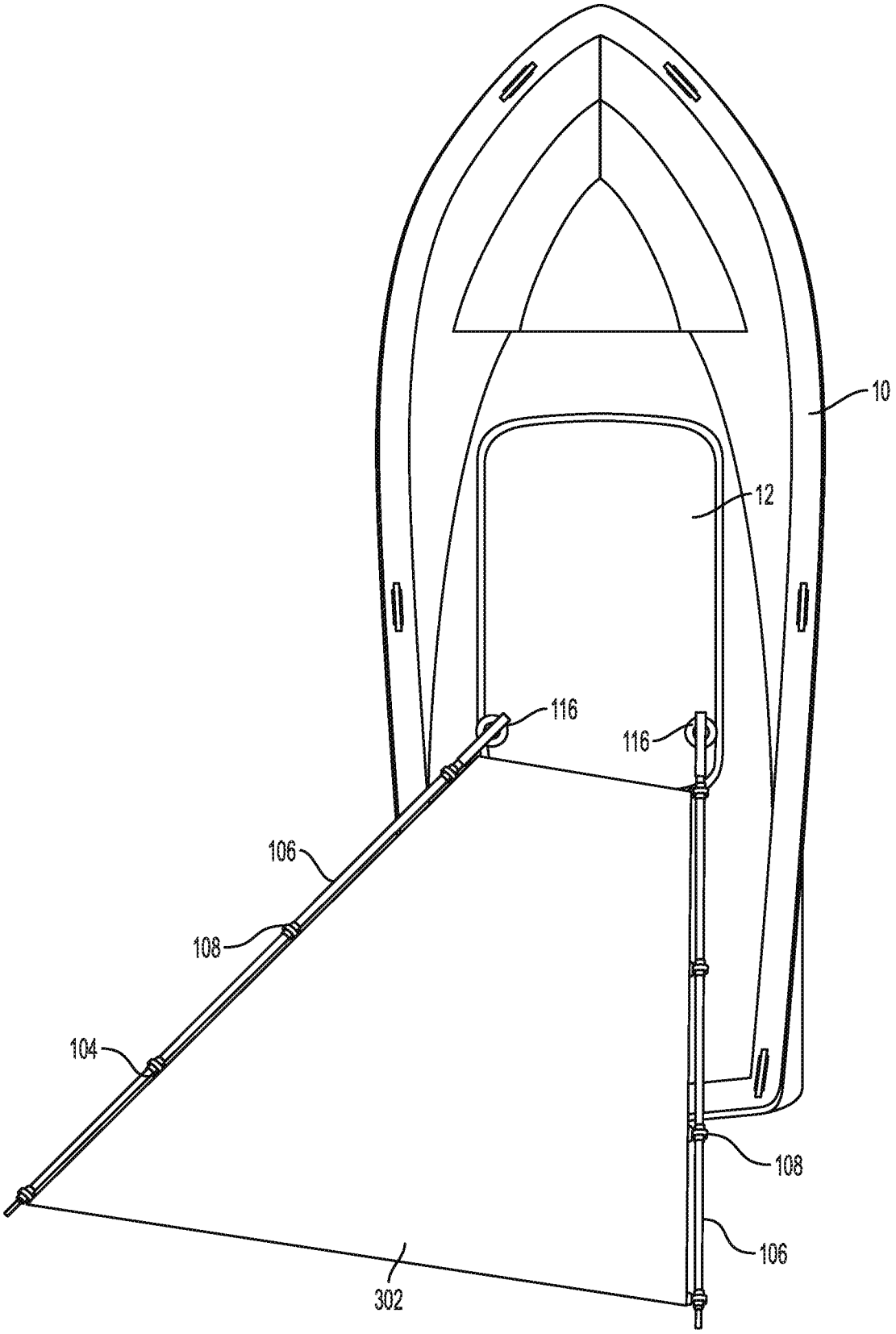
FIG. 17 is a top plan view of the repositionable shade system according to FIG. 15 attached to a typical boat.
Figure 18:
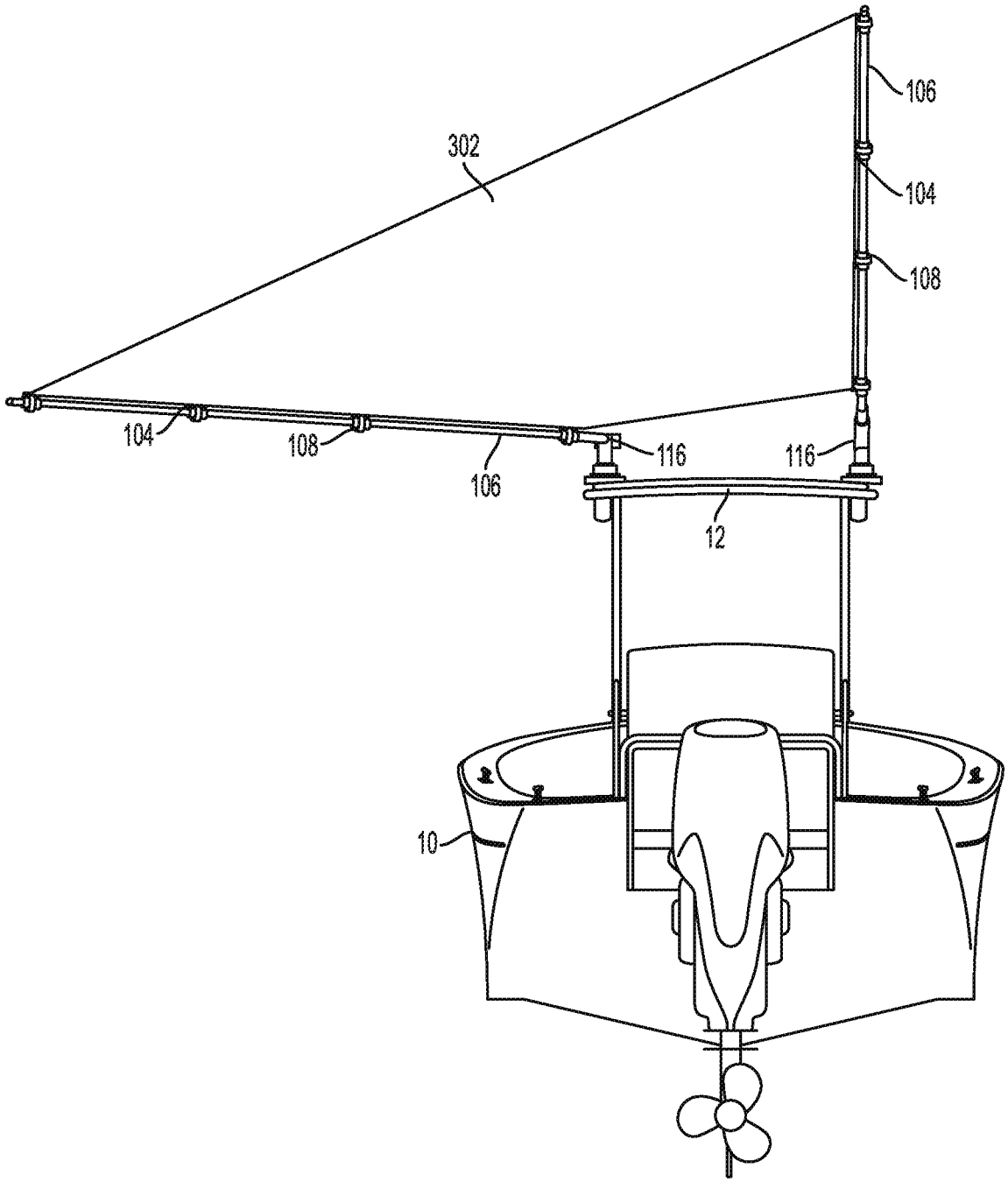
FIG. 18 is a rear elevation view of the repositionable shade system according to FIG. 15 attached to a typical boat.

As described above, a size and shape of the canvas may be adjusted, and a length and position of each of the poles 106 may be independently adjusted based on a user's needs. For example, as shown in FIG. 1, when the user desires the poles 106 to be parallel then the shape of the canvas 102 is a substantially rectangular shape to match a shape formed by the poles 106. As shown in FIG. 7, when the user desires a larger shaded/protected area, the poles 106 may be positioned so that they point at an angle away from each other. Accordingly, the canvases 202 and 302 may be a generally trapezoidal shape to match a shape formed by the poles 106. Further, the canvas may be held substantially taut by coupling the at least one attachment point 104 to the at least one pole 106 (or attachment point 114 of the clamp 108), and applying a spring force caused by the substantially small flex in the poles 106.

Figure 19:
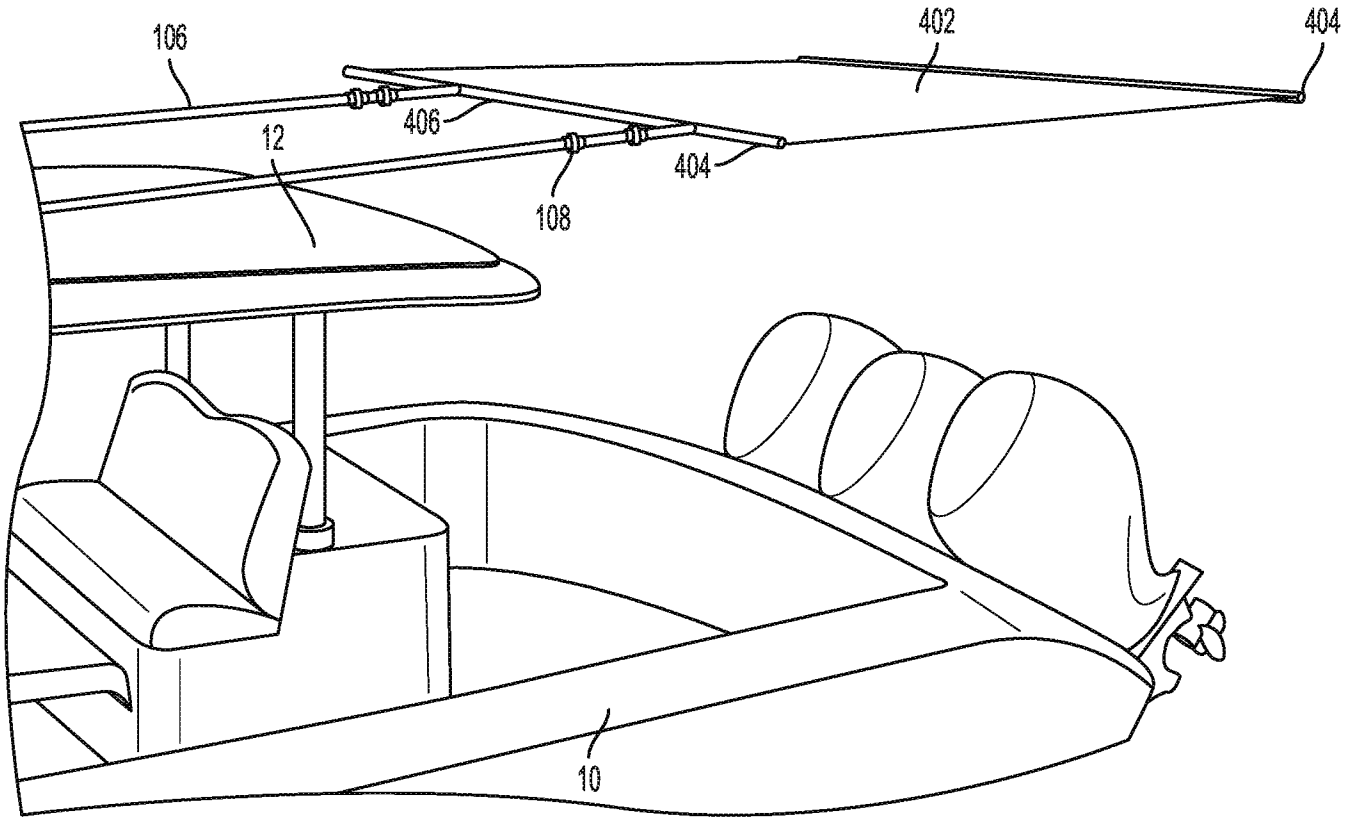
FIG. 19 is a perspective side view of a repositionable shade system positioned over a stern of a typical boat according to another embodiment of the present invention.
Figure 20:
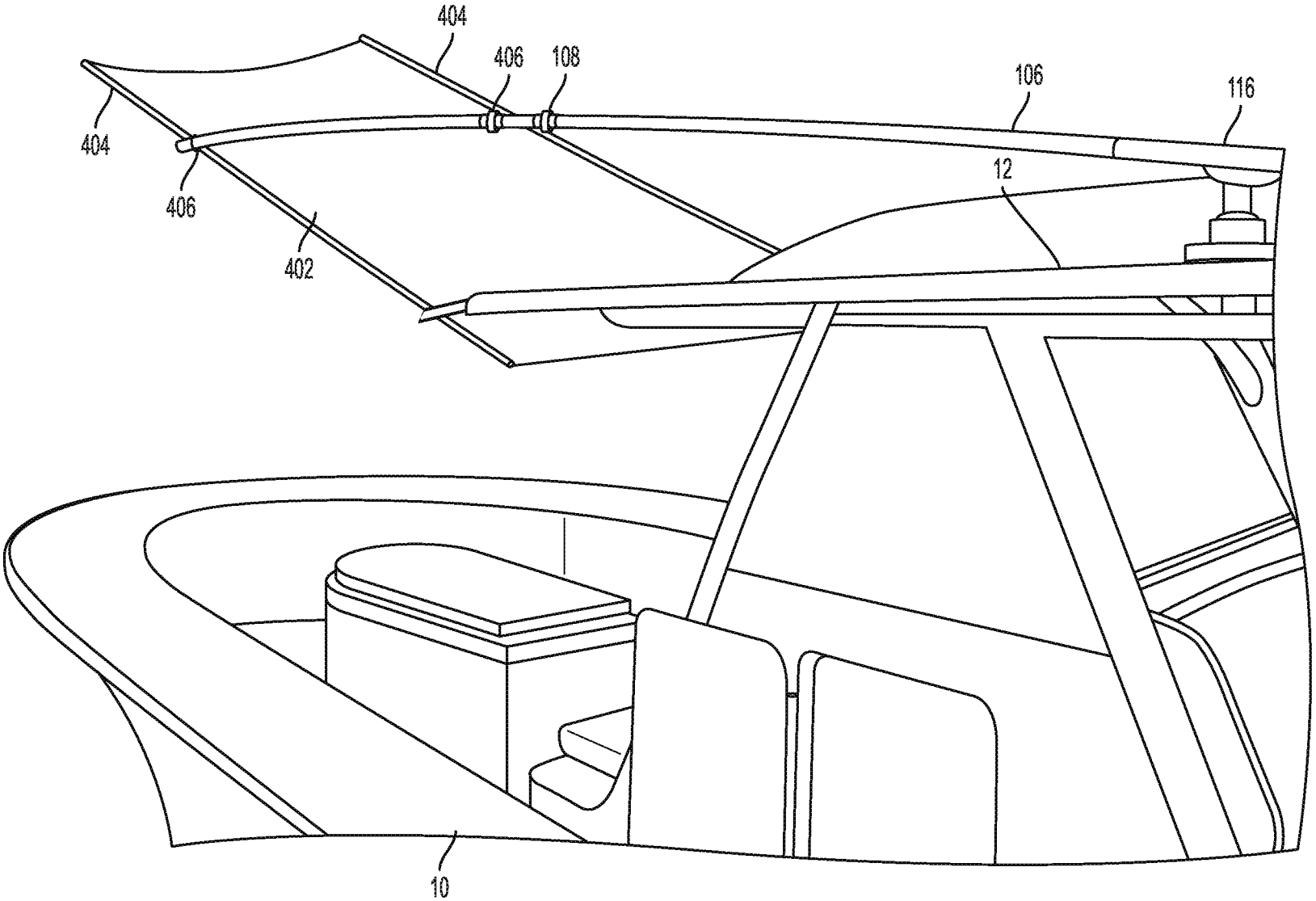
FIG. 20 is a perspective view of the repositionable shade system according to FIG. 19 positioned over a bow of a typical boat according to an embodiment of the present invention.

In another embodiment, referring to FIGS. 19 and 20, a canvas 402 includes first and second support poles 404 disposed at opposing ends of the canvas 402, and optionally one or more additional support poles between the opposing ends of the canvas 402. In this embodiment, first and second support poles 404 may also include stringer mechanisms 406 adapted to hold a width of the canvas 402 substantially taut (similar to the mechanism of a window type shade). Further, the stringer mechanisms 406 may be coupled to the respective poles 106 by respective attachment points 104. When the poles 106 are coupled to the stringer mechanisms 406, the canvas 402 may be wider than a distance between the poles 106 and provide a larger shaded/protected area.

In an embodiment, the shade/protection system includes two poles and two pivoting connections that are independently adjustable. The two pivoting connections may be adjusted to create a bias between the two poles along a vertical plane and the at least one canvas to be at a substantially complex angle relative to the boat 10. An example of a portion of a boat that may be used as a mounting surface for the pivoting connections 116 include, but is not limited to, is a tower 12 of the boat 10. The tower 12 is an upright structure on the boat that surrounds a cockpit area of the boat.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A shade system comprising:

first and second poles each having a longitudinal axis, wherein each of the first and second poles includes at least two nestable tubes and more than one clamp, wherein each clamp includes a guide that is adapted to rotate around the longitudinal axis, and each guide includes a first attachment point extending from the guide and forming an aperture;

first and second pivoting connections that are each adapted to couple to a mounting surface and respectively couple to ends of the first and second poles wherein the first and second pivoting connections are independently adjustable, and each of the first and second pivoting connections is adapted to selectively pivot the respective first and second poles in horizontal and vertical planes relative to the mounting surface; and a canvas having second attachment points adapted to respectively couple to the first attachment points, wherein the canvas is entirely supported by the coupling of the first and second attachment points and extends between the first and second poles to allow the canvas to provide a desired area of shade.

2. The shade system according to claim 1, wherein the canvas is adapted to provide shade from solar radiation.

3. The shade system according to claim 1, wherein the canvas is permeable to prevent excess force from being applied due to air.

4. The shade system according to claim 1, wherein the canvas includes a stringer mechanism adapted to hold a width of the canvas taut.

5. The shade system according to claim 4, wherein the stringer mechanism is coupled to at least one of the first and second poles by at least one of the first and second attachment points.

6. The shade system according to claim 1, wherein a length of each of the first and second poles is adjustable.

7. The shade system according to claim 6, wherein at least one of the clamps is adapted to secure an assembled length of the at least two nestable tubes.

8. The shade system according to claim 1, wherein each of the first and second poles is an outrigger pole and each of the clamps is an outrigger clamp.

9. The shade system according to claim 1, wherein at least one of the second attachment points is a strap extending from the canvas.

10. The shade system according to claim 9, wherein the strap has an adjustable length.

11. The shade system according to claim 1, wherein adjustment of the first and second pivoting connections holds the canvas substantially taut between the first and second poles along a vertical plane and allows the canvas to be positioned at a complex angle relative to the mounting surface.

12. The shade system according to claim 1, wherein the mounting surface is a portion of a boat.

13. The shade system of claim 1, wherein at least one of the second attachment points is a clip or a tether.

* * * * *